US010971345B2

(12) United States Patent
Kotani et al.

(10) Patent No.: US 10,971,345 B2
(45) Date of Patent: Apr. 6, 2021

(54) MASS SPECTROMETER AND MASS SPECTROMETRY METHOD

(71) Applicant: HAMAMATSU PHOTONICS K.K., Hamamatsu (JP)

(72) Inventors: Masahiro Kotani, Hamamatsu (JP); Takayuki Ohmura, Hamamatsu (JP)

(73) Assignee: HAMAMATSU PHOTONICS K.K., Hamamatsu (JP)

( * ) Notice: Subject to any disclaimer, the term of this patent is extended or adjusted under 35 U.S.C. 154(b) by 0 days.

(21) Appl. No.: 16/647,306

(22) PCT Filed: Jul. 31, 2018

(86) PCT No.: PCT/JP2018/028670
§ 371 (c)(1),
(2) Date: Mar. 13, 2020

(87) PCT Pub. No.: WO2019/058767
PCT Pub. Date: Mar. 28, 2019

(65) Prior Publication Data

US 2020/0219710 A1 Jul. 9, 2020

(30) Foreign Application Priority Data

Sep. 21, 2017 (JP) ..... JP2017-181611
Dec. 12, 2017 (JP) ..... JP2017-237846

(51) Int. Cl.
*H01J 49/04* (2006.01)
*H01J 49/00* (2006.01)

(52) U.S. Cl.
CPC ..... *H01J 49/0418* (2013.01); *H01J 49/0004* (2013.01)

(58) Field of Classification Search
CPC ..... H01J 49/0418; H01J 49/0004
See application file for complete search history.

(56) References Cited

FOREIGN PATENT DOCUMENTS

| | | | |
|---|---|---|---|
| JP | 4775821 | B2 | 9/2011 |
| JP | 4863692 | B2 | 1/2012 |
| JP | 2015-181098 | A | 10/2015 |
| WO | WO-2008/068847 | A1 | 6/2008 |
| WO | WO-2017/038709 | A1 | 3/2017 |

OTHER PUBLICATIONS

International Preliminary Report on Patentability dated Apr. 2, 2020 for PCT/JP2018/028670.

*Primary Examiner* — Nicole M Ippolito
*Assistant Examiner* — Hanway Chang
(74) *Attorney, Agent, or Firm* — Faegre Drinker Biddle & Reath LLP

(57) ABSTRACT

A mass spectrometer includes: a chamber; a support that, in a state in which, in a sample support body that includes a substrate in which a plurality of through-holes open in first and second surfaces are formed and a conductive layer that is at least provided on the first surface, the second surface thereof is in contact with a sample, supports the sample and the sample support body; a laser beam irradiation part that irradiates the first surface with a laser beam; a voltage application part that applies a voltage to the conductive layer; an ion detection part that, detects the ionized components of the sample in a space inside the chamber; a first light irradiation part that irradiates the sample with a first light from a side of the substrate; and an imaging part that obtains a reflected light image of the sample by the first light.

14 Claims, 8 Drawing Sheets

MASS SPECTROMETER AND MASS SPECTROMETRY METHOD

TECHNICAL FIELD

The present disclosure relates to a mass spectrometer and a mass spectrometry method.

BACKGROUND ART

A mass spectrometer that performs imaging mass spectrometry in which two-dimensional distribution of molecules composing a sample is imaged by detecting components of the sample ionized by matrix-assisted laser desorption/ionization (MALDI) is known (e.g., see Patent Literature 1). MALDI is a technique for ionizing a sample by adding a low-molecular weight organic compound, which is called a matrix and absorbs a laser beam, to a sample and irradiating it with the laser beam. In the imaging mass spectrometry based on MALDI, a visible ray image of a sample may be obtained along with an ion image of the sample.

CITATION LIST

Patent Literature

Patent Literature 1: Japanese Patent No. 4863692

SUMMARY OF INVENTION

Technical Problem

In the mass spectrometer described above, for instance, a thin film-like biological sample such as a tissue section is a target for the imaging mass spectrometry. However, in MALDI, there is a need to secure conductivity on a surface of the sample which is irradiated with the laser beam, and thus it is difficult to thicken the sample, for instance, a thickness of the sample is limited to about 10 μm. On the other hand, since the sample is thin with a thickness of about 10 μm or less, a transmitted light image of the sample is generally obtained as a visible ray image of the sample in the imaging mass spectrometry based on MALDI (e.g., see Patent Literature 1). However, in terms of securing signal intensity when components of an ionized sample are detected, a thick sample is preferably targeted for imaging mass spectrometry.

The present disclosure is directed to providing a mass spectrometer and a mass spectrometry method capable of targeting a thick sample for imaging mass spectrometry.

Solution to Problem

A mass spectrometer of an aspect of the present disclosure includes: a chamber configured to form a space to be evacuated; a support configured to, in a state in which, in a sample support body that includes a substrate in which a plurality of through-holes open in first and second surfaces facing each other are formed and a conductive layer that is at least provided on the first surface, the second surface thereof is in contact with a sample, support at least the sample and the sample support body; a laser beam irradiation part configured to irradiate the first surface with a laser beam; a voltage application part configured to apply a voltage to the conductive layer; an ion detection part configured to, in a state in which components of the sample have moved toward the first surface via the plurality of through-holes by a capillary phenomenon, detect the components ionized by irradiating the first surface with the laser beam while applying a voltage to the conductive layer in a space inside the chamber; a first light irradiation part configured to irradiate the sample with a first light from a side of the substrate; and an imaging part configured to obtain a reflected light image of the sample by the first light.

In the mass spectrometer, the components of the sample in the substrate of the supported sample support body have moved toward the first surface via the plurality of through-holes by a capillary phenomenon. Thus, positional information of the sample (information of two-dimensional distribution of molecules composing the sample) is maintained in the components of the sample that have moved toward the first surface of the substrate. In this state, since the first surface of the substrate is irradiated with the laser beam while a voltage is applied to the conductive layer, the components of the sample are ionized while the positional information of the sample is maintained. In this way, since a voltage is applied to the conductive layer in the state in which the components of the sample move toward the first surface of the substrate, the sample can be thickened without considering conductivity of the sample itself. Moreover, since the sample is irradiated with the first light from the side of the substrate, and the reflected light image of the sample by the first light (the image of the sample by the first light that transmits the conductive layer and the substrate and is reflected by the sample) is obtained, the sample can be thickened without considering, for instance, optical transparency in the sample. To be able to thicken the sample is advantageous for securing signal intensity when the ionized components are detected. As described above, according to the mass spectrometer, a thick sample can become a target for imaging mass spectrometry.

The mass spectrometer of the aspect of the present disclosure may further include a second light irradiation part configured to irradiate the sample with a second light from the opposite side of the substrate. The imaging part may obtain a transmitted light image of the sample by the second light. Thus, the reflected light image of the sample as well as the transmitted light image of the sample (the image of the sample by the second light that transmits the sample, the substrate, and the conductive layer) can be obtained depending on, for instance, the thickness of the sample.

The mass spectrometer of the aspect of the present disclosure may further include a switching part configured to switch the irradiation of the first light by the first light irradiation part or the irradiation of the second light by the second light irradiation part. Thus, it can be selected according to the thickness or the like of the sample S which one of the reflected light image or the transmitted light image is obtained as an image of the sample.

In the mass spectrometer of the aspect of the present disclosure, the imaging part may perform imaging with a plurality of imaging magnifications different from each other. Thus, the image of the sample can be obtained with a proper imaging magnification.

In the mass spectrometer of the aspect of the present disclosure, the laser beam irradiation part may scan a region corresponding to the sample with the laser beam, and the ion detection part may detect the ionized components so as to correspond to a scanning position of the laser beam. Thus, the imaging mass spectrometry may be properly performed.

In the mass spectrometer of the aspect of the present disclosure, the laser beam irradiation part may collectively irradiate a region corresponding to the sample with the laser beam, and the ion detection part may detect the ionized components while maintaining two-dimensional information of the region. Thus, the imaging mass spectrometry may be properly performed.

A mass spectrometer of an aspect of the present disclosure includes: a chamber configured to form a space to be evacuated; a support configured to, in a state in which, in a sample support body that includes a substrate which has conductivity and in which in which a plurality of through-holes open in first and second surfaces facing each other are formed, the second surface thereof is in contact with a sample, support at least the sample and the sample support body; a laser beam irradiation part configured to irradiate the first surface with a laser beam; a voltage application part configured to apply a voltage to the substrate; an ion detection part configured to, in a state in which components of the sample have moved toward the first surface via the plurality of through-holes by a capillary phenomenon, detect the components ionized by irradiating the first surface with the laser beam while applying a voltage to the substrate in a space inside the chamber; a first light irradiation part configured to irradiate the sample with a first light from a side of the substrate; and an imaging part configured to obtain a reflected light image of the sample by the first light.

According to the mass spectrometer, the conductive layer may be omitted in the sample support body, and the same effect as the case where the sample support body having the conductive layer as described above is used can be obtained.

A mass spectrometry method of an aspect of the present disclosure includes: a first process of, in a state in which, in a sample support body that includes a substrate which has conductivity and in which a plurality of through-holes open in first and second surfaces facing each other are formed and a conductive layer that is at least provided on the first surface, the second surface thereof is in contact with a sample, supporting at least the sample and the sample support body in a space to be evacuated; a second process of irradiating the first surface with a laser beam while applying a voltage to the conductive layer in a state in which components of the sample have moved toward the first surface via the plurality of through-holes by a capillary phenomenon; a third process of detecting the components ionized by irradiating the first surface with the laser beam while applying a voltage to the conductive layer in the space; and a fourth process of irradiating the sample with a first light from a side of the substrate and obtaining a reflected light image of the sample by the first light.

In the mass spectrometry method, the components of the sample in the substrate of the supported sample support body are kept moved toward the first surface via the plurality of through-holes by a capillary phenomenon. Thus, positional information of the sample (information of two-dimensional distribution of molecules composing the sample) is maintained in the components of the sample that have moved toward the first surface of the substrate. In this state, since the first surface of the substrate is irradiated with the laser beam while a voltage is applied to the conductive layer, the components of the sample are ionized while the positional information of the sample is maintained. In this way, since a voltage is applied to the conductive layer in the state in which the components of the sample move toward the first surface of the substrate, the sample can be thickened without considering conductivity of the sample itself. Moreover, since the sample is irradiated with the first light from the side of the substrate, and the reflected light image of the sample by the first light is obtained, the sample can be thickened without considering, for instance, optical transparency in the sample. To be able to thicken the sample is advantageous for securing signal intensity when the ionized components are detected. As described above, according to the mass spectrometry method, a thick sample can become a target for imaging mass spectrometry.

In the mass spectrometry method of the aspect of the present disclosure, the fourth process may be performed before the third process. Thus, a state of the sample can be observed before the sample is subjected to a certain influence by the irradiation of the laser beam.

In the mass spectrometry method of the aspect of the present disclosure, the fourth process may be performed after the third process. Thus, the state of the sample can be observed on the basis of the result of the imaging mass spectrometry.

The mass spectrometry method of the aspect of the present disclosure may further include a fifth process of irradiating the sample with the first light from the side of the substrate and obtaining the reflected light image of the sample by the first light with an imaging magnification higher than in the fourth process. Thus, the state of the sample can be observed in greater detail.

In the mass spectrometry method of the aspect of the present disclosure, the second process and the third process may be performed on a partial region extracted from a region corresponding to the sample on the basis of the reflected light image obtained in the fifth process. Thus, a specified portion of the sample can become a target for the imaging mass spectrometry.

The mass spectrometry method of the aspect of the present disclosure may further include a sixth process of irradiating the sample with a second light from the opposite side of the substrate and obtaining a transmitted light image of the sample by the second light. Thus, the reflected light image of the sample as well as the transmitted light image of the sample can be obtained depending on, for instance, a thickness of the sample.

A mass spectrometry method of an aspect of the present disclosure includes: a first process of, in a state in which, in a sample support body that includes a substrate which has conductivity and in which a plurality of through-holes open in first and second surfaces facing each other are formed, the second surface thereof is in contact with a sample, supporting at least the sample and the sample support body in a space to be evacuated; a second process of irradiating the first surface with a laser beam while applying a voltage to the substrate in a state in which components of the sample have moved toward the first surface via the plurality of through-holes by a capillary phenomenon; a third process of detecting the components ionized by irradiating the first surface with the laser beam while applying a voltage to the conductive layer in the space; and a fourth process of irradiating the sample with a first light from a side of the substrate and obtaining a reflected light image of the sample by the first light.

According to the mass spectrometry method, the conductive layer may be omitted in the sample support body, and the same effect as the case where the sample support body having the conductive layer as described above is used can be obtained.

Advantageous Effects of Invention

According to the present disclosure, a mass spectrometer and a mass spectrometry method capable of targeting a thick sample for imaging mass spectrometry can be provided.

DESCRIPTION OF EMBODIMENTS

Hereinafter, an embodiment of the present disclosure will be described in detail with reference to the drawings. Note that the same or equivalent portions are denoted by the same reference signs in each of the drawings, and duplicate descriptions thereof will be omitted.

Figure 1:
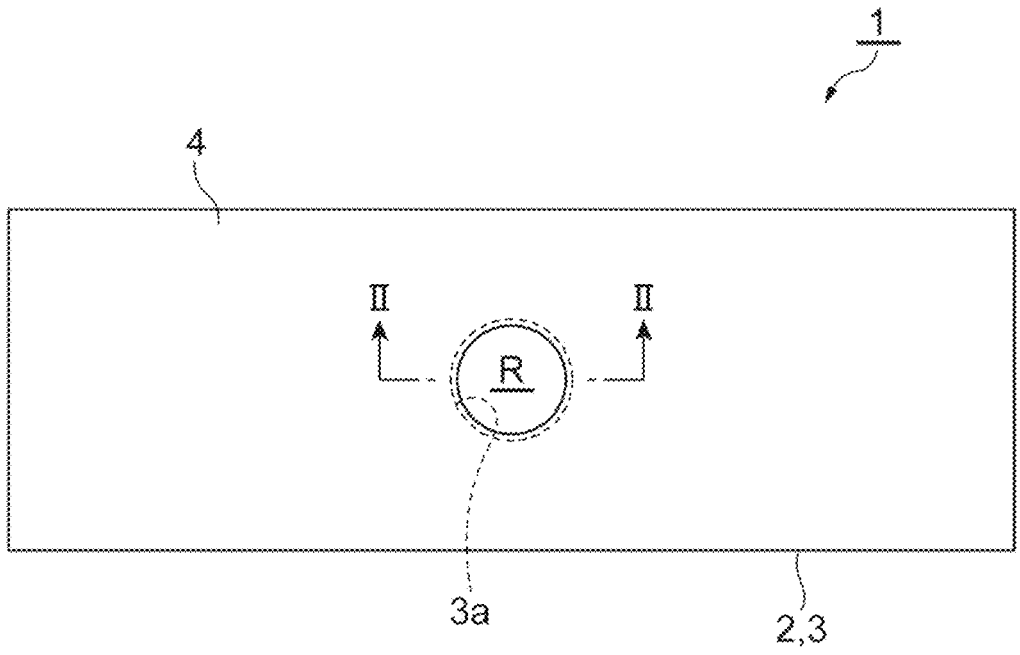
FIG. 1 is a top view of a sample support body used in a mass spectrometer and a mass spectrometry method of an embodiment.
Figure 2:
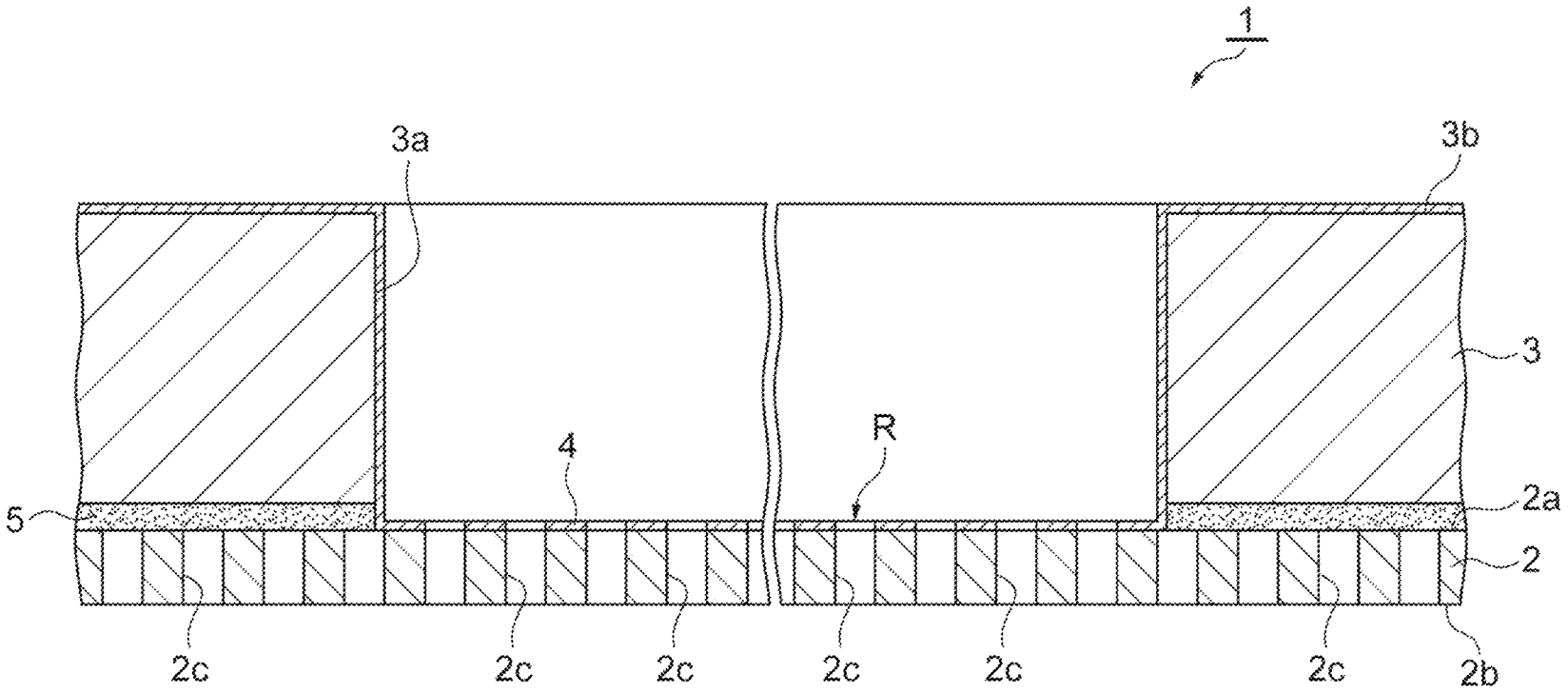
FIG. 2 is a sectional view of the sample support body along line II-II illustrated in FIG. 1.

First, a sample support body used in a mass spectrometer and a mass spectrometry method of an embodiment will be described. As illustrated in FIGS. 1 and 2, a sample support body 1 includes a substrate 2, a frame 3, and a conductive layer 4. The substrate 2 has a first surface 2*a* and a second surface 2*b* that face each other. A plurality of through-holes 2*c* are formed in the substrate 2 in a uniform manner (with uniform distribution). Each of the through-holes 2*c* extends in a thickness direction of the substrate 2 (a direction perpendicular to the first surface 2*a* and the second surface 2*b*), and opens in the first surface 2*a* and the second surface 2*b*.

The substrate 2 is formed of, for instance, an insulating material in the shape of a rectangular plate. When viewed in the thickness direction of the substrate 2, a length of one side of the substrate 2 is, for instance, several centimeters or so, and a thickness of the substrate 2 is, for instance, about 1 μm to 50 μm. When viewed in the thickness direction of the substrate 2, shapes of the through-holes 2*c* are, for instance, nearly circular shapes. Widths of the through-holes 2*c* are, for instance, about 1 nm to 700 nm. The widths of the through-holes 2*c* are diameters of the through-holes 2*c* in a case where, when viewed in the thickness direction of the substrate 2, the shapes of the through-holes 2*c* are the nearly circular shapes, and are diameters (effective diameters) of virtual maximum columns fitted into the through-holes 2*c* in a case where the shapes are not the nearly circular shapes.

The frame 3 is provided on the first surface 2*a* of the substrate 2. To be specific, the frame 3 is fixed to the first surface 2*a* of the substrate 2 by a bonding layer 5. As a material of the bonding layer 5, a bonding material (e.g., a low melting point glass, a bond for vacuum, etc.) having little discharge gas is preferably used. When viewed in the thickness direction of the substrate 2, the frame 3 has nearly the same outline as the substrate 2. An opening 3*a* is formed in the frame 3. A portion of the substrate 2 which corresponds to the opening 3*a* functions as an effective region R for moving components of a sample toward the first surface 2*a* by means of a capillary phenomenon (to be described below).

The frame 3 is formed of, for instance, an insulating material in the shape of a rectangular plate. When viewed in the thickness direction of the substrate 2, a length of one side of the frame 3 is, for instance, several centimeters or so, and a thickness of the frame 3 is, for instance, 1 mm or less. When viewed in the thickness direction of the substrate 2, a shape of the opening 3*a* is, for instance, a circular shape. In that case, a diameter of the opening 3*a* is, for instance, about several millimeters to tens of millimeters. Due to this frame 3, handling of the sample support body 1 is facilitated, and deformation of the substrate 2 caused by, for instance, a change in temperature is curbed.

The conductive layer 4 is provided on the first surface 2*a* of the substrate 2. To be specific, the conductive layer 4 is continuously (integrally) formed in a region of the first surface 2*a* of the substrate 2 which corresponds to the opening 3*a* of the frame 3 (i.e., a region corresponding to the effective region R), an inner surface of the opening 3*a*, and a surface 3*b* of the frame 3 which is located on the opposite side of the substrate 2. The conductive layer 4 covers a portion of the first surface 2*a* of the substrate 2 at which the through-holes 2*c* are not formed in the effective region R. That is, the through-holes 2*c* are exposed through the opening 3*a* in the effective region R.

The conductive layer 4 is formed of a conductive material. However, as a material of the conductive layer 4, for the reason to be described below, a metal having a low affinity (reactivity) with a sample and high conductivity is preferably used.

For example, if the conductive layer 4 is formed of a metal such as copper (Cu) that has a high affinity with a sample such as a protein, the sample is ionized in a state in which Cu atoms are attached to sample molecules in a process (to be described below) of ionizing the sample, and there is a chance of detected results deviating in mass spectrometry (to be described below) in proportion when the Cu atoms are attached. Therefore, as the material of the conductive layer 4, a metal having a low affinity with a sample is preferably used.

Meanwhile, a constant voltage is easily applied to a metal having higher conductivity in an easy and stable way. For this reason, if the conductive layer 4 is formed of a high-conductivity metal, a voltage can be uniformly applied to the first surface 2*a* of the substrate 2 in the effective region R. Further, a metal having higher conductivity also shows a tendency to have higher thermal conductivity. For this reason, if the conductive layer 4 is formed of a high-conductivity metal, the energy of a laser beam with which the substrate 2 is irradiated can be efficiently transmitted to a sample via the conductive layer 4. Therefore, as the material of the conductive layer 4, a high-conductivity metal is preferably used.

In view of this, for example, gold (Au), platinum (Pt), or the like is used as the material of the conductive layer 4. For example, the conductive layer 4 is formed at a thickness of about 1 nm to 350 nm using a plating method, an atomic layer deposition (ALD) method, a vapor deposition method, a sputtering method, or the like. For example, chromium (Cr), nickel (Ni), titanium (Ti), etc. may be used as the material of the conductive layer 4.

Figure 3:
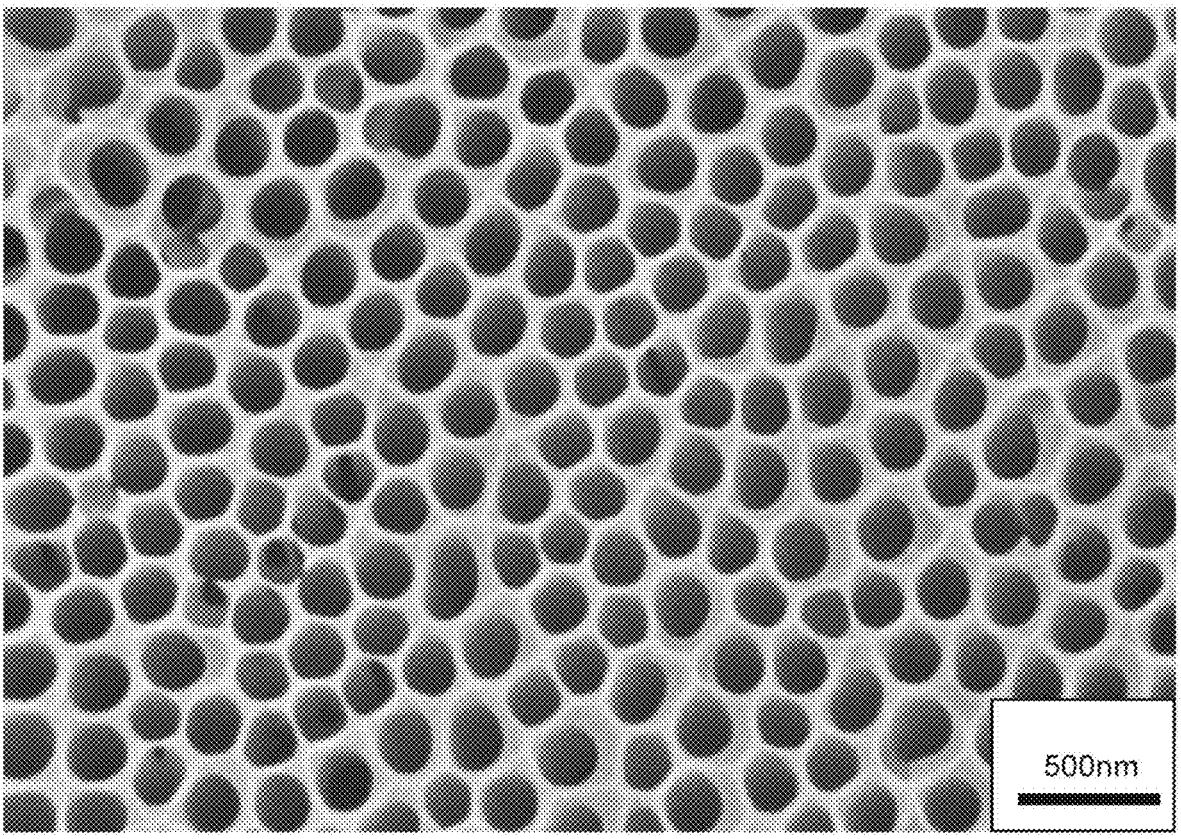
FIG. 3 is a view illustrating an enlarged image of a substrate of the sample support body illustrated in FIG. 1.

FIG. 3 is a view illustrating an enlarged image of the substrate 2 when viewed in the thickness direction of the substrate 2. In FIG. 3, black portions are the through-holes 2*c*, and white portions are partition wall portions between the through-holes 2*c*. As illustrated in FIG. 3, the plurality of through-holes 2*c* having approximately constant widths are uniformly formed in the substrate 2. An aperture ratio of the through-holes 2*c* in the effective region R (a ratio of all the through-holes 2*c* to the effective region R when viewed in the thickness direction of the substrate 2) ranges from 10% to 80% in view of practicality, and particularly preferably ranges from 60% to 80%. The sizes of the plurality of through-holes 2*c* may not be even with one another, and the plurality of through-holes 2*c* may be coupled to one another.

The substrate 2 illustrated in FIG. 3 is an alumina porous film formed by anodizing aluminum (Al). To be specific, the substrate 2 can be obtained by anodizing an Al substrate and peeling an oxidized surface portion from the Al substrate. The substrate 2 may be formed by anodizing a valve metal other than Al such as tantalum (Ta), niobium (Nb), titanium (Ti), hafnium (Hf), zirconium (Zr), zinc (Zn), tungsten (W), bismuth (Bi), antimony (Sb), or the like, or by anodizing silicon (Si).

Figure 4:
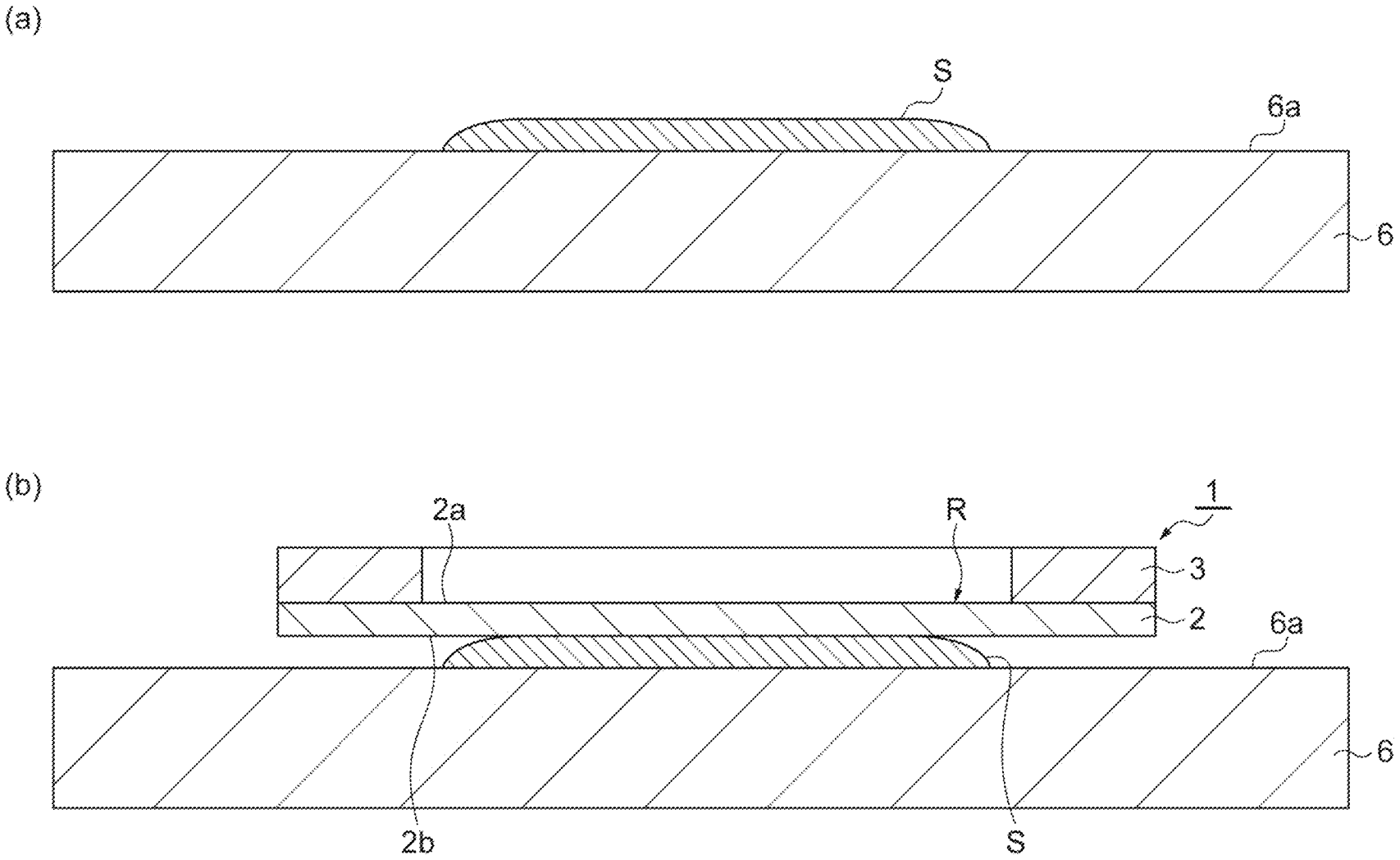
FIG. 4 is a view illustrating a process of the mass spectrometry method of the embodiment.
Figure 5:
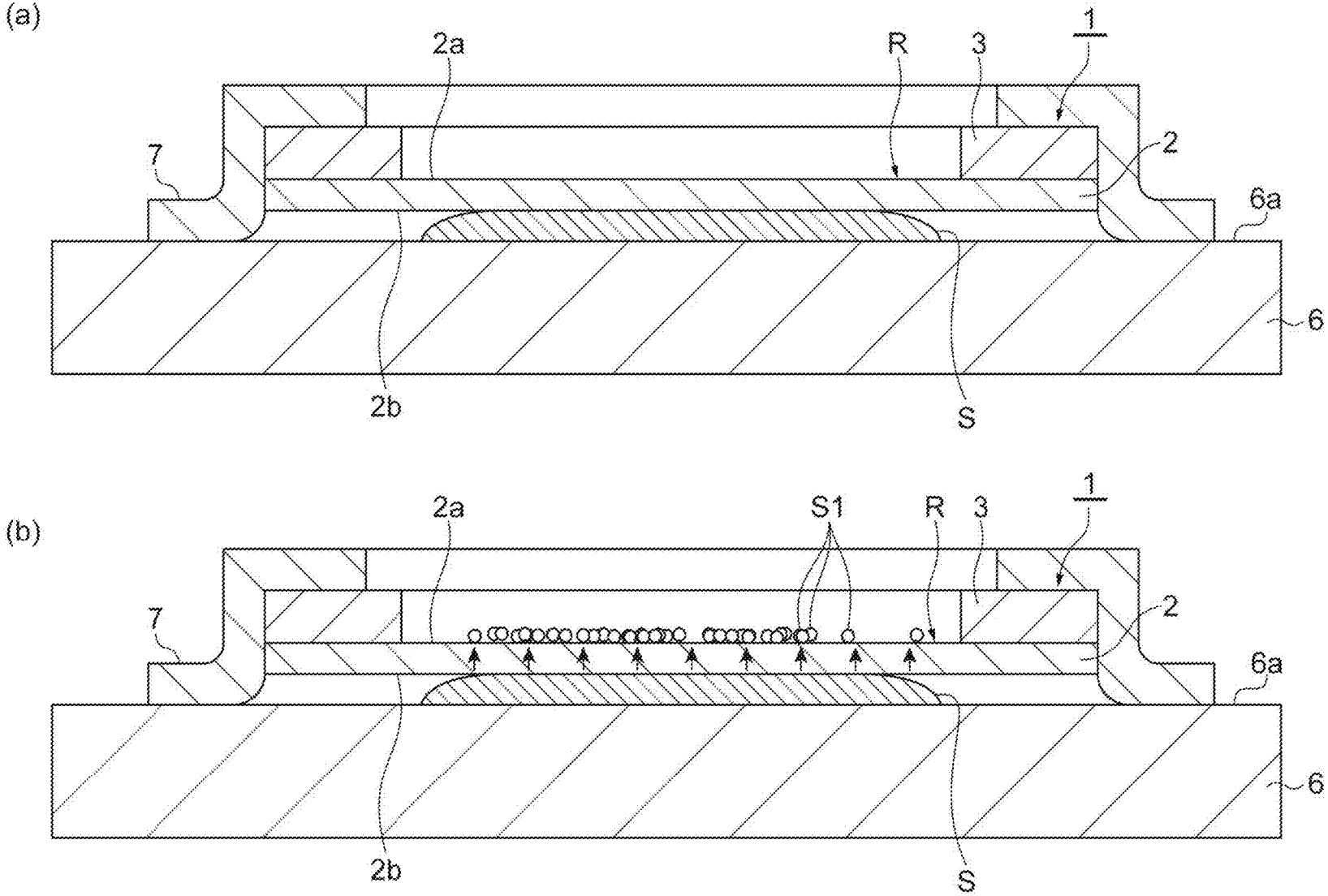
FIG. 5 is a view illustrating a process of the mass spectrometry method of the embodiment.
Figure 6:
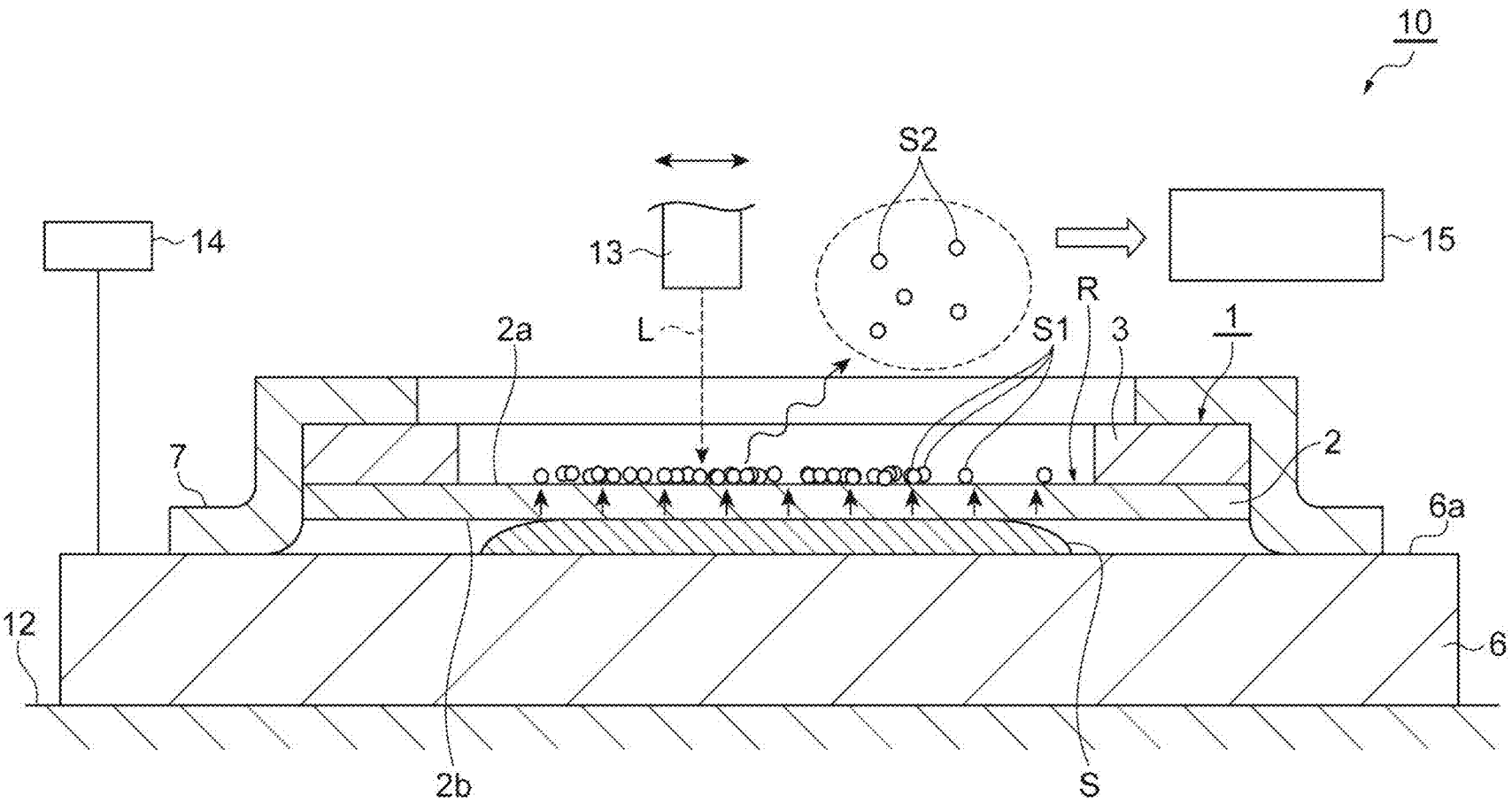
FIG. 6 is a view illustrating a process of the mass spectrometry method of the embodiment.

Next, an outline of the mass spectrometry method using the sample support body 1 will be described. In FIGS. 4 to 6, the through-holes 2*c*, the conductive layer 4, and the bonding layer 5 are not illustrated in the sample support body 1. Further, for convenience of illustration, for instance ratios of dimensions are different in the sample support body 1 illustrated in FIGS. 1 and 2 and the sample support body 1 illustrated in FIGS. 4 to 6.

First, the aforementioned sample support body 1 is prepared. The sample support body 1 may be prepared by being manufactured by a person who carries out the mass spectrometry method, or by being obtained from a manufacturer or a seller.

Next, as illustrated in (a) of FIG. 4, a sample S is mounted on a mounting surface 6*a* of a slide glass 6. The slide glass 6 is a glass substrate on which a transparent conductive film such as an indium tin oxide (ITO) film is formed, and a surface of the transparent conductive film becomes the mounting surface 6*a*. Without being limited to the slide glass 6, a member capable of securing conductivity (e.g., a substrate formed of a metal material such as stainless steel) may be used as the mount. Next, as illustrated in (b) of FIG. 4, the second surface 2*b* of the substrate 2 is brought into contact with the sample S, and in this state, as illustrated in (a) of FIG. 5, the sample support body 1 is fixed to the slide glass 6. In this case, the sample S is disposed in the effective region R when viewed in the thickness direction of the substrate 2. Further, the sample support body 1 is fixed to the slide glass 6 by a tape 7 (e.g., a carbon tape) having conductivity. To be specific, the tape 7 comes into contact with the conductive layer 4 on the first surface 2*a* of the substrate 2, and comes into contact with the mounting surface 6*a* of the slide glass 6, and thus the sample support body 1 is fixed to the slide glass 6. The tape 7 may be a part of the sample support body 1, or may be prepared separately from the sample support body 1. In a case where the tape 7 is a part of the sample support body 1 (i.e., in a case where the sample support body 1 includes the tape 7), for instance the tape 7 may be fixed on the side of the first surface 2*a* at a circumferential edge of the substrate 2 in advance. To be more specific, the tape 7 may be fixed on the conductive layer 4 at the circumferential edge of the substrate 2. Here, the sample S is, for instance, a thin film-like biological sample (a hydrous sample) such as a tissue section.

Next, as illustrated in (b) of FIG. 5, in a state in which the sample S is disposed between the slide glass 6 and the sample support body 1, components S1 of the sample S move toward the first surface 2*a* of the substrate 2 via the plurality of through-holes 2*c* (see FIG. 2) by a capillary phenomenon. The components S1 that have moved toward the first surface 2*a* of the substrate 2 stay on the side of the first surface 2*a* due to surface tension. In a case where the sample S is a dried sample, a solution (e.g., an acetonitrile liquid mixture) for reducing viscosity of the sample S is added to the sample S. Thereby, the components S1 of the sample S can be moved toward the first surface 2*a* of the substrate 2 via the plurality of through-holes 2*c* by a capillary phenomenon.

Next, as illustrated in FIG. 6, in the state in which the sample S is disposed between the slide glass 6 and the sample support body 1, the slide glass 6, the sample support body 1, and the sample S are mounted on a support 12 (e.g., a stage) of a mass spectrometer 10. Next, a voltage is applied to the conductive layer 4 of the sample support body 1 (see FIG. 2) via the mounting surface 6*a* of the slide glass 6 and the tape 7 by a voltage application part 14 of the mass spectrometer 10. Next, the first surface 2*a* of the substrate 2 is irradiated with a laser beam L via the opening 3*a* of the frame 3 by a laser beam irradiation part 13 of the mass spectrometer 10. That is, a region of the first surface 2*a* of the substrate 2 (i.e., a region corresponding to the effective region R) which corresponds to the opening 3*a* of the frame 3 is irradiated with the laser beam L. Here, the laser beam irradiation part 13 scans the region corresponding to the effective region R with the laser beam L.

In this way, the first surface 2*a* of the substrate 2 is irradiated with the laser beam L while a voltage is applied to the conductive layer 4. Thus, the components S1 that have moved toward the first surface 2*a* of the substrate 2 are ionized, and sample ions S2 (ionized components S1) are discharged. To be specific, energy is transmitted from the conductive layer 4 (see FIG. 2) absorbing energy of the laser beam L to the components S1 that have moved toward the first surface 2*a* of the substrate 2, and the components S1 obtaining the energy are evaporated and obtain electric charges to become the sample ions S2.

Figure 7:
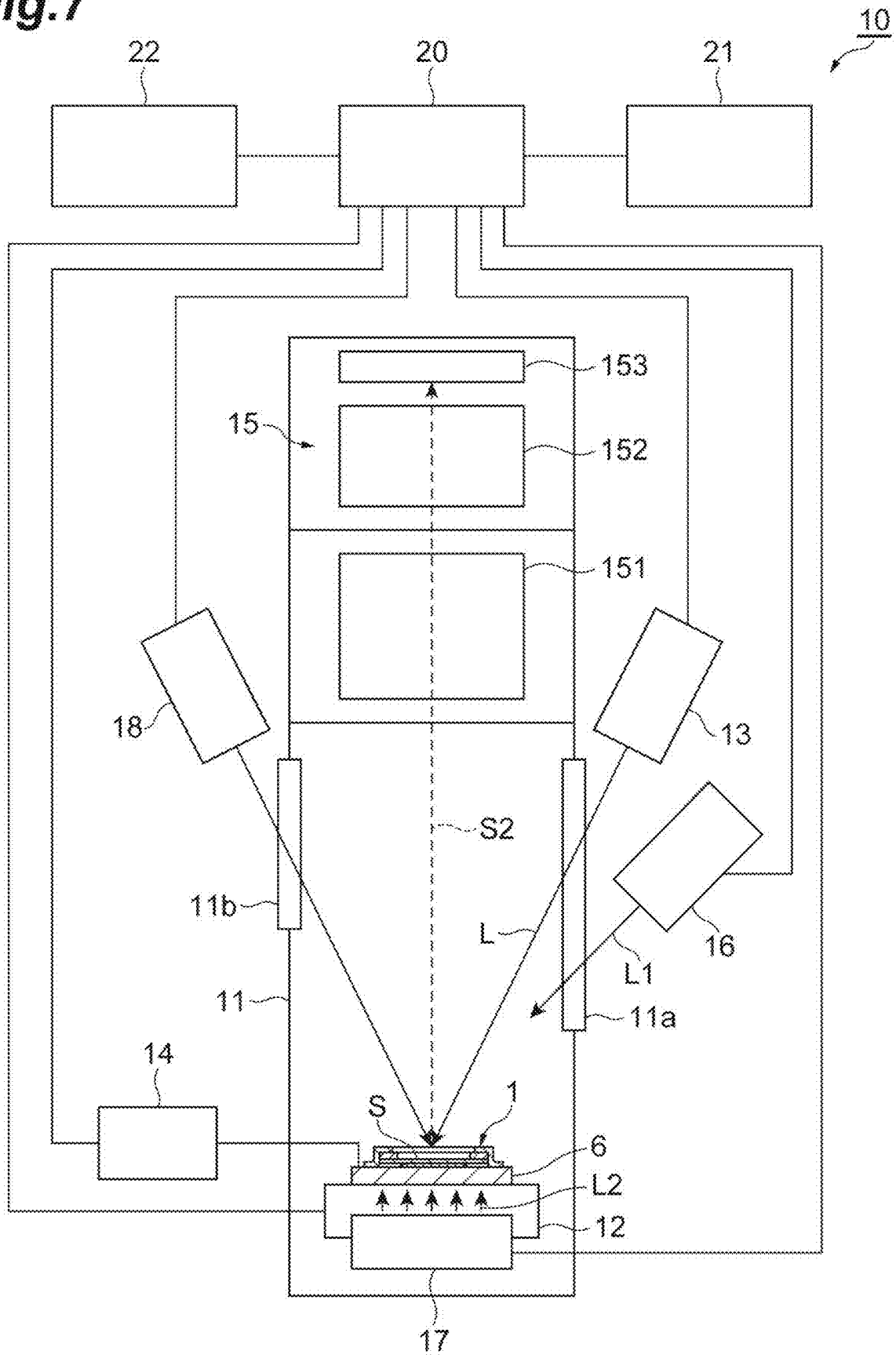
FIG. 7 is a configuration view of a mass spectrometer of an embodiment.

The discharged sample ions S2 are pulled into a mass separator 152 (see FIG. 7) by a difference in pressure between the support 12 side and an ion detection part 15 side and an electric field of an ion guide 151 (see FIG. 7). The sample ions S2 are separated in the mass separator 152 according to mass. The sample ions S2 separated according to mass are detected by an ion detector 153 (see FIG. 7). Here, the ion detector 153 detects the sample ions S2 to correspond to a scanning position of the laser beam L. Thus, two-dimensional distribution of molecules composing the sample S can be imaged. Here, the mass spectrometer 10 is a scanning mass spectrometer using time-of-flight mass spectrometry (TOF-MS).

The mass spectrometer of the embodiment will be described on the basis of a configuration of the above sample support body 1 and the outline of the mass spectrometry method. As illustrated in FIG. 7, the mass spectrometer 10 includes a chamber 11, the support 12, the laser beam irradiation part 13, the voltage application part 14, the ion detection part 15, a first light irradiation part 16, a second light irradiation part 17, an imaging part 18; a controller (a switching part) 20, an operating part 21, and a display 22. Since a configuration around the support 12 of the mass spectrometer 10 illustrated in FIG. 7 is the same as the configuration around the support 12 of the mass spectrometer 10 illustrated in FIG. 6, FIG. 6 will also be referred to below in addition to FIG. 7.

The chamber 11 forms a space to be evacuated. In the state in which the sample S is disposed between the slide glass 6 and the sample support body 1, the support 12 supports the slide glass 6, the sample support body 1, and the sample S in the space inside the chamber 11. The support 12 is, for instance, a stage that can be operated along a plane perpendicular to the thickness direction of the substrate 2. The laser beam irradiation part 13 irradiates the first surface 2*a* of the sample support body 1 supported by the support 12 with the laser beam L via a window part 11*a* provided on the chamber 11. The laser beam L is, for instance, a light having a wavelength of an ultraviolet region. The voltage application part 14 applies a voltage to the conductive layer 4 (see FIG. 2) of the sample support body 1 supported by the support 12, for instance, via the mounting surface 6*a* of the slide glass 6 and the tape 7.

The ion detection part 15 detects the sample ions S2 (i.e., the components S1 of the sample S ionized by irradiating the first surface 2*a* with the laser beam L while applying a voltage to the conductive layer 4) in the space inside the chamber 11. When the first surface 2*a* is irradiated with the laser beam L while a voltage is applied to the conductive layer 4, the components S1 of the sample S have moved toward the first surface 2*a* via the plurality of through-holes 2*c* by a capillary phenomenon.

In the mass spectrometer 10, the support 12 is operated by a controller 20, and thus the laser beam irradiation part 13 scans the region corresponding to the effective region R (the region corresponding to the sample S) with the laser beam L, and the ion detection part 15 detects the sample ions S2 that correspond to a scanning position of the laser beam L. That is, the mass spectrometer 10 is a scanning mass spectrometer. At least one of the support 12 and the laser beam irradiation part 13 is operated by the controller 20, and thus scanning the region corresponding to the effective region R with the laser beam L can be performed.

The ion detection part 15 has the ion guide 151, the mass separator 152, and the ion detector 153. The sample ions S2 discharged to the space inside the chamber 11 are pulled into the mass separator 152 by a difference in pressure between the support 12 side and the ion detection part 15 side and an electric field of the ion guide 151. The sample ions S2 are separated in the mass separator 152 according to mass. The sample ions S2 separated according to mass are detected by the ion detector 153.

The first light irradiation part 16 irradiates the sample S supported by the support 12 with a first light L1 from the side of the substrate 2 via the window part 11*a*. The second light irradiation part 17 is provided on the support 12, and irradiates the sample S supported by the support 12 with a second light L2 from the opposite side of the substrate 2 via the slide glass 6. The first light L1 and the second light L2 are, for instance, visible rays. The irradiation of the first light L1 performed by the first light irradiation part 16 or the irradiation of the second light L2 performed by the second light irradiation part 17 is switched by the controller 20. The imaging part 18 obtains either a reflected light image of the sample S by the first light L1 (an image of the sample S by the first light L1 that transmits the conductive layer 4 and the substrate 2 and is reflected by the sample 5) or a transmitted light image of the sample S by the second light L2 (an image of the sample S by the second light L2 that transmits the sample S, the substrate 2, and the conductive layer 4) via a window part 11*b* provided on the chamber 11. The imaging part 18 switches, for instance, a plurality of lens units, and thus imaging is possible with a plurality of imaging magnifications that are different from each other. If at least a thickness of the substrate 2 is about 1 μm to 50 μm, a thickness of the conductive layer 4 is about 1 nm to 350 nm, widths of the through-holes 2*c* are about 1 nm to 700 nm, and an aperture ratio of the through-holes 2*c* in the effective region R is 10 to 80%, the reflected light image of the sample S by the first light L1 and the transmitted light image of the sample S by the second light L2 can be obtained.

The controller 20 controls operations of the parts of the mass spectrometer 10, and performs imaging mass spectrometry in which two-dimensional distribution of molecules composing the sample S is imaged on the basis of the detected result of the sample ions S2 by the ion detection part 15. The controller 20 is configured as a computer that includes a processor, a memory, a storage, and a communication device. The operating part 21 is an interface for an operator to input an instruction or the like. The display 22 displays a two-dimensional distribution image of molecules composing the sample S, a reflected light image of the sample S by the first light L1, a transmitted light image of the sample S by the second light L2, and so on.

Figure 8:
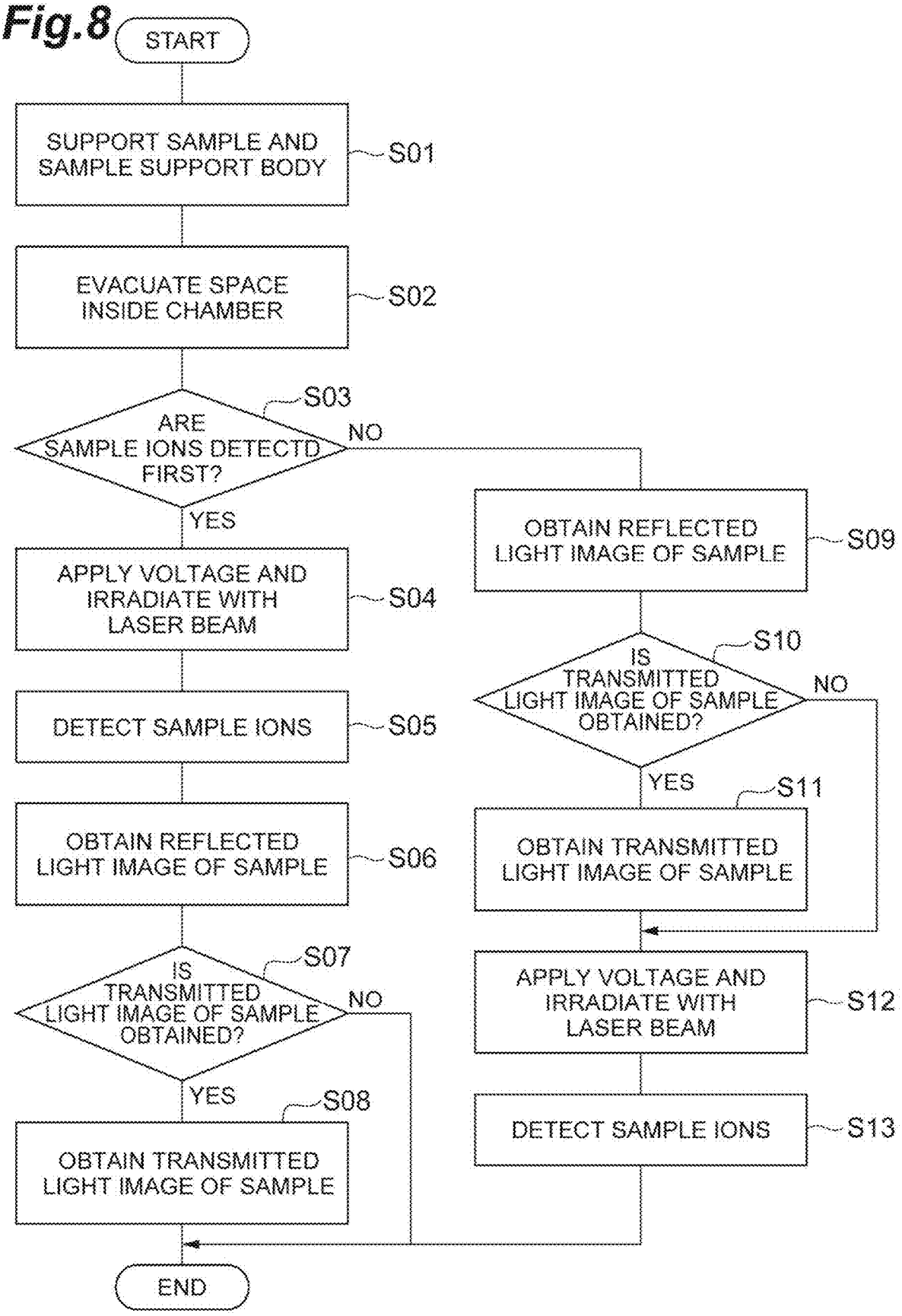
FIG. 8 is a flow chart of the mass spectrometry method of the embodiment.

Next, the mass spectrometry method of the embodiment which is performed in the aforementioned mass spectrometer 10 will be described with reference to a flow chart of FIG. 8. First, the slide glass 6, the sample support body 1, and the sample S, which are in the state in which the sample S is disposed between the slide glass 6 and the sample support body 1, are mounted on the support 12 by an operator (step S01). In this state, the space inside the chamber 11 is evacuated, and is maintained at a prescribed degree of vacuum (step S02). That is, in a state in which the second surface 2*b* of the sample support body 1 is in contact with the sample S, the sample S and the sample support body 1 are supported in the evacuated space inside the chamber 11 by the support 12 (a first process).

Next, it is selected by an operator via the operating part 21 whether to first detect the sample ions S2 or to first obtain the reflected light image of the sample S (step S03). In a case where it is selected to first detect the sample ions S2, the first surface 2*a* is irradiated with a laser beam L by the laser beam irradiation part 13 while a voltage is applied to the conductive layer 4 by the voltage application part 14 in a state in which the components S1 of the sample S have moved toward the first surface 2*a* via the plurality of through-holes 2*c* by a capillary phenomenon (step S04, a second process). The sample ions S2 (i.e., the components S1 of the sample S ionized by irradiating the first surface 2*a* with the laser beam L while applying a voltage to the conductive layer 4) are detected in the evacuated space inside the chamber 11 by the ion detection part 15, and imaging mass spectrometry is performed by the controller 20 on the basis of the detected result (step S05, a third process).

Next, the sample S is irradiated with a first light L1 from the side of the substrate 2 by the first light irradiation part 16, and the reflected light image of the sample S by the first light L1 is obtained by the imaging part 18 (step S06, a fourth process). Next, it is selected by an operator via the operating part 21 whether or not to obtain the transmitted light image of the sample S (step S07). In a case where it is selected to obtain the transmitted light image of the sample S, the sample S is irradiated with a second light L2 from the opposite side of the substrate 2 by the second light irradiation part 17, and the transmitted light image of the sample S by the second light L2 is obtained by the imaging part 18 (step S08, a sixth process). If the transmitted light image of the sample S is obtained in step S08 or if it is selected not to obtain the transmitted light image of the sample S in step S07, this mass spectrometry method is terminated.

In a case where it is selected in step S03 to first obtain the reflected light image of the sample S, the sample S is irradiated with the first light L1 from the side of the substrate 2 by the first light irradiation part 16, and the reflected light image of the sample S by the first light L1 is obtained by the imaging part 18 (step S09, the fourth process). Next, it is selected by an operator via the operating part 21 whether or not to obtain the transmitted light image of the sample S (step S10). In a case where it is selected to obtain the transmitted light image of the sample S, the sample S is irradiated with the second light L2 from the opposite side of the substrate 2 by the second light irradiation part 17, and the transmitted light image of the sample S by the second light L2 is obtained by the imaging part 18 (step S11, the sixth process).

If the transmitted light image of the sample S is obtained in step S11 or if it is selected not to obtain the transmitted light image of the sample S in step S10, the first surface 2*a* is irradiated with the laser beam L by the laser beam irradiation part 13 while a voltage is applied to the conductive layer 4 by the voltage application part 14 in the state in which the components S1 of the sample S have moved toward the first surface 2*a* via the plurality of through-holes 2*c* by a capillary phenomenon (step S12, the second process). The sample ions S2 are detected in the evacuated space inside the chamber 11 by the ion detection part 15, and the imaging mass spectrometry is performed by the controller 20 on the basis of the detected result (step S13, the third process). If the imaging mass spectrometry is performed by the controller 20, this mass spectrometry method is terminated.

As described above, in the mass spectrometer 10 and the mass spectrometry method performed in the mass spectrometer 10, the components of the sample S in the substrate 2 of the supported sample support body 1 have moved toward the first surface 2*a* via the plurality of through-holes 2*c* by a capillary phenomenon. Thus, positional information of the sample S (information of two-dimensional distribution of molecules composing the sample S) is maintained in the components S1 of the sample S that have moved toward the first surface 2*a* of the substrate 2. In this state, since the first surface 2*a* of the substrate 2 is irradiated with the laser beam L while a voltage is applied to the conductive layer 4, the components S1 of the sample S are ionized while the positional information of the sample S is maintained. In this way, since a voltage is applied to the conductive layer 4 in the state in which the components S1 of the sample S have moved toward the first surface 2*a* of the substrate 2, the sample S can be thickened without considering conductivity of the sample S itself. Moreover, since the sample S is irradiated with the first light L1 from the side of the substrate 2, and the reflected light image of the sample S by the first light L1 is obtained, the sample S can be thickened without considering, for instance, optical transparency in the sample S. In the present embodiment, the sample S can be thickened, for instance, up to about 100 μm. To be able to thicken the sample S is advantageous for securing signal intensity when the sample ions S2 are detected. As described above, according to the mass spectrometer 10 and the mass spectrometry method performed in the mass spectrometer 10, a thick sample S can become a target for imaging mass spectrometry. According to the mass spectrometer 10 and the mass spectrometry method performed in the mass spectrometer 10, an ion image and a visible ray image of the thick sample S (e.g., the sample S having a thickness greater than 10 μm), measurement of which is difficult with an existing mass spectrometer and an existing mass spectrometry method, can be obtained. According to the mass spectrometer 10 and the mass spectrometry method performed in the mass spectrometer 10, as long as the sample support body 1 is not damaged, a sample S having a thickness on the order of hundreds of microns (preferably, a sample S which has a thickness of 20 μm to 100 μm, measurement of which is difficult with MALDI) can be a measuring target.

Further, in a case where the second light irradiation part 17 irradiates the sample S with the second light L2 from the opposite side of the substrate 2, the imaging part 18 can obtain the transmitted light image of the sample S by the second light L2. Thus, the reflected light image of the sample S as well as the transmitted light image of the sample S can be obtained depending on, for instance the thickness of the sample S.

Further, the controller 20 can switch the irradiation of the first light L1 by the first light irradiation part 16 or the irradiation of the second light L2 by the second light irradiation part 17. Thus, it can be selected according to the thickness or the like of the sample S which one of the reflected light image or the transmitted light image is obtained as an image of the sample S.

Further, the imaging part 18 can perform imaging with the plurality of imaging magnifications different from each other. Thus, an image of the sample S can be obtained with a proper imaging magnification.

Further, the laser beam irradiation part 13 scans the region corresponding to the sample S with the laser beam L, and the ion detection part 15 detects the sample ions S2 so as to correspond to the scanning position of the laser beam L. Thus, the imaging mass spectrometry can be properly performed.

Further, in a case where the image of the sample S is obtained before the sample ions S2 is detected, a state of the sample S before the sample S is subjected to a certain influence by the irradiation of the laser beam L can be observed. Further, a target region for the mass spectrometry can be reliably designated on the basis of the obtained image of the sample S. Further, although the sample S shrinks when the space inside the chamber 11 is evacuated, an image of the shrunken sample S is obtained, and thus the image of the sample S and the two-dimensional distribution image of molecules composing the sample S can be accurately matched. In a device in which an ionization part is under the atmospheric pressure (atmospheric pressure MALDI), activity of a living microorganism can be observed until just before the irradition of the laser beam L.

Further, in a case where the image of the sample S is obtained after the sample ions S2 is detected, the state of the sample S can be observed on the basis of the result of the imaging mass spectrometry. Further, in a case where an operator wants to perform more detailed spectrometry, the image of the sample S can be obtained while increasing a magnification without removing the sample S from the mass spectrometer 10, and the target region for the mass spectrometry can be easily designated on the basis of the obtained image of the sample S.

Further, obtained results of measurement can be considered while observing the sample S inside the mass spectrometer 10 (during that time, the state of the sample S can be maintained inside the mass spectrometer 10).

In the mass spectrometry method performed in the mass spectrometer 10, the reflected light image of the sample S by the first light L1 or the transmitted light image of the sample S by the second light L2 may be further obtained with an imaging magnification higher than in steps S06 and S08 (the fifth process), and steps S04 and S05 may be again performed on a partial region extracted from the region corresponding to the sample S on the basis of the obtained reflected light image or the obtained transmitted light image. Further, the reflected light image of the sample S by the first light L1 or the transmitted light image of the sample S by the second light L2 may be further obtained with an imaging magnification higher than in steps S09 and S11 (the fifth process), and steps S12 and S13 may be again performed on a partial region extracted from the region corresponding to the sample S on the basis of the obtained reflected light image or the obtained transmitted light image. The reflected light image or the transmitted light image of the sample S is obtained with a high imaging magnification, and thereby the state of the sample S can be observed in more detail. Further, the detection of the sample ions S2 is performed on a partial region extracted from the region corresponding to the sample S, and thereby a specified portion of the sample S can become a target for the imaging mass spectrometry.

The present disclosure is not limited to the aforementioned embodiment. For example, if the conductive layer 4 is at least provided on the first surface 2*a* of the substrate 2, the conductive layer 4 may not be provided on the second surface 2*b* of the substrate 2 and inner surfaces of the through-holes 2*c*, or may be provided on the second surface 2*b* of the substrate 2 and the inner surfaces of the through-holes 2*c*. Further, the sample support body 1 may be fixed to the slide glass 6 by a means other than the tape 7 (e.g., a means using a bond, a fixing tool, etc.). Further, the sample S may be directly mounted on the support 12 of the mass spectrometer 10, and the sample support body 1 may be fixed to the support 12. That is, the slide glass 6 may be omitted.

Further, the voltage application part 14 may apply a voltage to the conductive layer 4 without using the mounting surface 6*a* of the slide glass 6 and the tape 7. In that case, the slide glass 6 and the tape 7 may not have conductivity. Further, the substrate 2 may have conductivity, and the voltage application part 14 may apply a voltage to the substrate 2. According to the mass spectrometer 10 and the mass spectrometry method performed in the mass spectrometer 10, the conductive layer 4 can be omitted in the sample support body 1, and the same effect as the case where the sample support body 1 having the conductive layer 4 as described above is used can be obtained.

Further, in the mass spectrometer 10, the reflected light image of the sample S and the transmitted light image of the sample S may be obtained by the imaging parts provided separately. Further, the mass spectrometer 10 may not include the second light irradiation part 17. That is, the irradiation of the second light L2 to the sample S and the obtainment of the transmitted light image of the sample S by the second light L2 may be omitted. Further, in the mass spectrometer 10, the laser beam irradiation part 13 may collectively irradiate the region corresponding to the effective region R with the laser beam L, and the ion detection part 15 may detect the sample ions S2 while maintaining two-dimensional information of the region. That is, the mass spectrometer 10 may be a projection type mass spectrometer. Even in that case, the imaging mass spectrometry can be properly performed.

In a case where the mass spectrometer 10 is a projection type mass spectrometer, the mass spectrometer 10 has an electrostatic lens instead of the ion guide 151 and the mass separator 152. The electrostatic lens is a lens for imaging the sample ions S2 onto the ion detector 153. The sample ions S2 are imaged onto the ion detector 153 by the electrostatic lens, and thus the positional information (the two-dimensional distribution) of the sample ions S2 is identified in the ion detector 153

Further, the use of the sample support body 1 is not limited to the ionization of the sample S caused by the irradiation of the laser beam L. The sample support body 1 may be used in the ionization of the sample S caused by irradiation of an energy beam (e.g., an ion beam, an electron beam, etc.) other than the laser beam L.

REFERENCE SIGNS LIST

1: sample support body, 2: substrate, 2*a*: first surface, 2*b*: second surface, 2*c*: through-hole, 4: conductive layer, 10: mass spectrometer, 11: chamber, 12: support, 13: laser beam irradiation part, 14: voltage application part, 15: ion detection part, 16: first light irradiation part, 17: second light irradiation part, 18: imaging part, 20: controller (switching part), L1: first light, L2: second light, S: sample.

The invention claimed is:

1. A mass spectrometer comprising:

a chamber configured to form a space to be evacuated;

a support configured to, in a state in which, in a sample support body that includes a substrate in which a plurality of through-holes open in first and second surfaces facing each other are formed and a conductive layer that is at least provided on the first surface, the second surface thereof is in contact with a sample, support at least the sample and the sample support body;

a laser beam irradiation part configured to irradiate the first surface with a laser beam;

a voltage application part configured to apply a voltage to the conductive layer;

an ion detection part configured to, in a state in which components of the sample have moved toward the first surface via the plurality of through-holes by a capillary phenomenon, detect the components ionized by irradiating the first surface with the laser beam while applying a voltage to the conductive layer in a space inside the chamber;

a first light irradiation part configured to irradiate the sample with a first light from a side of the substrate; and an imaging part configured to obtain a reflected light image of the sample by the first light.

2. The mass spectrometer according to claim 1, further comprising a second light irradiation part configured to irradiate the sample with a second light from an opposite side of the substrate, wherein the imaging part obtains a transmitted light image of the sample by the second light.

3. The mass spectrometer according to claim 2, further comprising a switching part configured to switch the irradiation of the first light by the first light irradiation part or the irradiation of the second light by the second light irradiation part.

4. The mass spectrometer according to claim 1, wherein the imaging part enables imaging with a plurality of imaging magnifications different from each other.

5. The mass spectrometer according to claim 1, wherein:

the laser beam irradiation part scans a region corresponding to the sample with the laser beam; and the ion detection part detects the ionized components so as to correspond to a scanning position of the laser beam.

6. The mass spectrometer according to claim 1, wherein:

the laser beam irradiation part collectively irradiates a region corresponding to the sample with the laser beam; and the ion detection part detects the ionized components while maintaining two-dimensional information oft the region.

7. A mass spectrometer comprising:

a chamber configured to form a space to be evacuated;

a support configured to, in a state in which, in a sample support body that includes a substrate which has conductivity and in which a plurality of through-holes open in first and second surfaces facing each other are formed, the second surface thereof is in contact with a sample, support at least the sample and the sample support body;

a laser beam irradiation part configured to irradiate the first surface with a laser beam;

a voltage application part configured to apply a voltage to the substrate;

an ion detection part configured to, in a state in which components of the sample have moved toward the first surface via the plurality of through-holes by a capillary phenomenon, detect the components ionized by irradiating the first surface with the laser beam while applying a voltage to the substrate in a space inside the chamber;

a first light irradiation part configured to irradiate the sample with a first light from a side of the substrate; and an imaging part configured to obtain a reflected light image of the sample by the first light.

8. A mass spectrometry method comprising:

a first process of, in a state in which, in a sample support body that includes a substrate in which a plurality of through-holes open in first and second surfaces facing each other are formed and a conductive layer that is at least provided on the first surface, the second surface thereof is in contact with a sample, supporting at least the sample and the sample support body in a space to be evacuated;

a second process of irradiating the first surface with a laser beam while applying a voltage to the conductive layer in a state in which components of the sample have moved toward the first surface via the plurality of through-holes by a capillary phenomenon;

a third process of detecting the components ionized by irradiating the first surface with the laser beam while applying a voltage to the conductive layer in the space; and a fourth process of irradiating the sample with a first light from a side of the substrate and obtaining a reflected light image of the sample by the first light.

9. The mass spectrometry method according to claim 8, wherein the fourth process is performed before the third process.

10. The mass spectrometry method according to claim 8, wherein the fourth process is performed after the third process.

11. The mass spectrometry method according to claim 8, further comprising a fifth process of irradiating the sample with the first light from the side of the substrate and obtaining the reflected light image of the sample by the first light with an imaging magnification higher than in the fourth process.

12. The mass spectrometry method according to claim 11, wherein the second process and the third process are performed on a partial region extracted from a region corresponding to the sample on the basis of the reflected light image obtained in the fifth process.

13. The mass spectrometry method according to claim 8, further comprising a sixth process of irradiating the sample with a second light from an opposite side of the substrate and obtaining a transmitted light image of the sample by the second light.

14. A mass spectrometry method comprising:

a first process of, in a state in which, in a sample support body that includes a substrate which has conductivity and in which a plurality of through-holes open in first and second surfaces facing each other are formed, the second surface thereof is in contact with a sample, supporting at least the sample and the sample support body in a space to be evacuated;

a second process of irradiating the first surface with a laser beam while applying a voltage to the substrate in a state in which components of the sample have moved toward the first surface via the plurality of through-holes by a capillary phenomenon;

a third process of detecting the components ionized by irradiating the first surface with the laser beam while applying a voltage to the substrate in the space; and a fourth process of irradiating the sample with a first light from a side of the substrate and obtaining a reflected light image of the sample by the first light.

* * * * *